United States Patent [19]

Buckle

[11] 4,009,583

[45] Mar. 1, 1977

[54] BUOYANCY CONTROL APPARATUS FOR DIVERS

[76] Inventor: Brian Leonard Buckle, 16, Sunningdale Heights, Colwyn Bay, North Wales, England

[22] Filed: Oct. 7, 1975

[21] Appl. No.: 620,275

[52] U.S. Cl. ..... 61/70; 9/316; 128/142 R

[51] Int. Cl.[2] ..... B63C 11/02

[58] Field of Search ..... 61/70, 69 R, 69 A; 114/16 E; 9/342, 316; 128/142 R, 142.7

[56] References Cited

UNITED STATES PATENTS

| | | | |
|---|---|---|---|
| 3,379,023 | 4/1968 | Crose | 61/70 |
| 3,495,413 | 2/1970 | Pinto | 61/69 R |
| 3,605,418 | 9/1971 | Levine | 61/69 R |
| 3,716,009 | 2/1973 | Strickland | 114/16 E |

*Primary Examiner*—Jacob Shapiro
*Attorney, Agent, or Firm*—Oblon, Fisher, Spivak, McClelland & Maier

[57] ABSTRACT

A buoyancy control system for carrying by a diver has a fluid-tight reservoir, preferably of looped tubing, into which water and compressed gas can be selectively admitted through respective inlet valves to displace gas and water respectively in the reservoir through respective outlet valves. The relative amounts of water and gas in the reservoir can therefore be adjusted to provide a required degree of buoyancy for the diver.

11 Claims, 6 Drawing Figures

BUOYANCY CONTROL APPARATUS FOR DIVERS

The present invention relates to the control of buoyancy of a diver and provides a buoyancy control apparatus whereby buoyancy of the diver can be varied in accordance with the desired operating depth of the diver.

According to the present invention, there is provided a buoyancy control apparatus adapted to be carried by a diver and comprising a fluid-tight reservoir; a water inlet valve for admitting water to said reservoir from externally of the apparatus; a water outlet valve for releasing water from the reservoir to externally of the apparatus; a gas inlet valve for admitting compressed gas to the reservoir; and a gas outlet valve for releasing gas from the reservoir, the arrangement being such that water or gas can be admitted to the reservoir to displace gas or water respectively already in the reservoir thereby to change the buoyancy of the apparatus.

Usually the water inlet and outlet valves will connect the reservoir with the ambient environment of the apparatus.

It is preferred that the apparatus is a self-contained unit including a source of compressed gas, usually air. When the compressed gas is of the same type as that used as a life-support for the diver, the gas for breathing and for buoyancy control may be supplied from the same compressed gas reservoir. However, separate compressed gas reservoirs can be used for breathing and normal buoyancy control. In order to provide additional compressed gas for emergency purposes, especially when rapid ascent (i.e. rapid increase in buoyancy) is required, a second gas inlet valve may be provided to admit to the fluid reservoir compressed gas at a higher pressure than that normally admitted, i.e. by the first gas inlet valve. That second gas inlet valve may be supplied from the life-support reservoir or from an auxiliary compressed gas reservoir. The gas supplied to the first gas inlet valve preferably is of the order of hundreds of pounds pressure per square inch, typically 200 psi, whereas that supplied to the second valve preferably is of the order of thousands of pounds pressure per square inch, typically 3,000 psi. The latter pressure is conveniently that at which compressed gas is usually supplied in cylinders for diving purposes. Such a cylinder may be used to provide gas to the first gas inlet valve via a pressure reducer.

The fluid reservoir preferably is constituted by fluid-tight tubing, especially hoses of, for example one-and-three quarter inch diameter, capable of withstanding the pressures of the fluid contained during operation of the apparatus. Said pressures usually would be less than 40 psi. Suitably, the tubing is coiled or looped to reduce the overall dimensions of the reservoir. The tubing may be constituted by two or more equal lengths of tubing commencing in a common fluid inlet manifold and terminating in a common fluid outlet chamber or separate but commonly operated outlet chambers. Non-return valves may be provided in the tubing to prevent fluid flow towards one or both of the water inlet valve and the gas inlet valve.

The water inlet valve and the gas outlet valve preferably are controlled by a common manually operable mechanism. The water inlet valve itself may be opened directly by operation of said mechanism but the gas outlet valve advantageously is operated by compressed gas pressure via a control valve operated by said common mechanism The mechanism may be biased to a closed position by, for example, a spring and movable to an open position by depressing an operating handle, for example in the form of a push button. When depressed, the handle opens the water inlet valve and also connects an actuator of the gas outlet valve to a compressed gas source thereby causing said outlet valve to open. The source of compressed gas may be the same as that supplying compressed gas to the gas inlet valve but connected to the actuator at its full pressure, i.e. without passage through a pressure reducer. When the handle is released, it returns to its closed position thereby closing the water inlet valve and connecting said actuator to an exhaust port to permit the gas outlet valve to close under, for example, a spring bias.

The water outlet valve suitably may be actuated by fluid pressure in the reservoir at a predetermined threshold level. Thus, the valve may be a spring-loaded pressure release valve openable by a pressure of, for example, 40 psi. This valve may be located at an outlet chamber common with a gas outlet valve and where more than one outlet chambers are provided each may have a pair of water outlet and gas outlet valves.

The gas inlet valve and, when present, the second gas inlet valve may each be a manually actuated valve, for example a screw-operated valve of the kind commonly used in compressed gas systems.

As mentioned above, the apparatus preferably is a self-contained unit. It is preferred that such a unit is adapted to be carried as a back-pack by the diver. To this end, the apparatus preferably comprises a housing for location on a diver's back to accommodate at least the bulk of the apparatus and means for carrying the housing in that position. Said means suitably comprises a pair of arms adapted to extend from the housing over the diver's shoulders. These arms advantageously are joined at their free ends in a control unit incorporating manually operable controls for the valves. These arms can be hollow to carry from the housing the end section or sections of the tubing and the compressed gas supply pipe or pipes.

The following is a description by way of example only and with reference to the accompanying informal drawings of a buoyancy control apparatus in accordance with a preferred embodiment of the invention. In the drawings.

Figure 1:
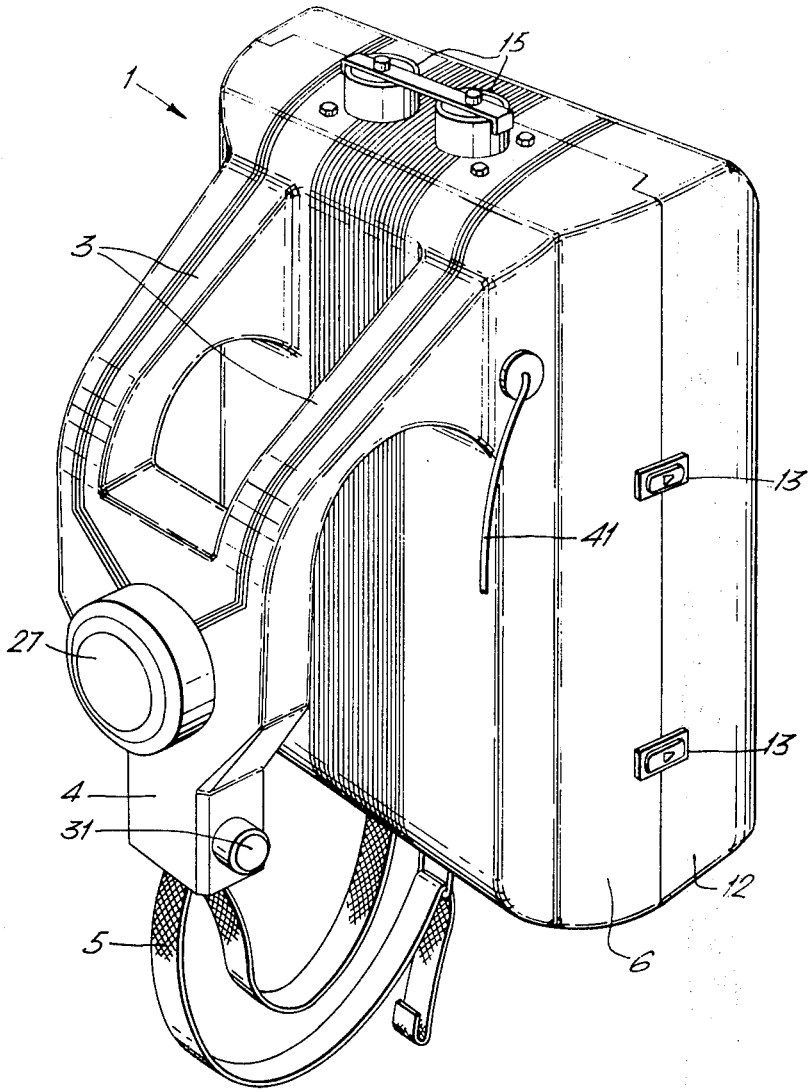
FIG. 1 is a perspective front view of a buoyancy control apparatus.
Figure 2:
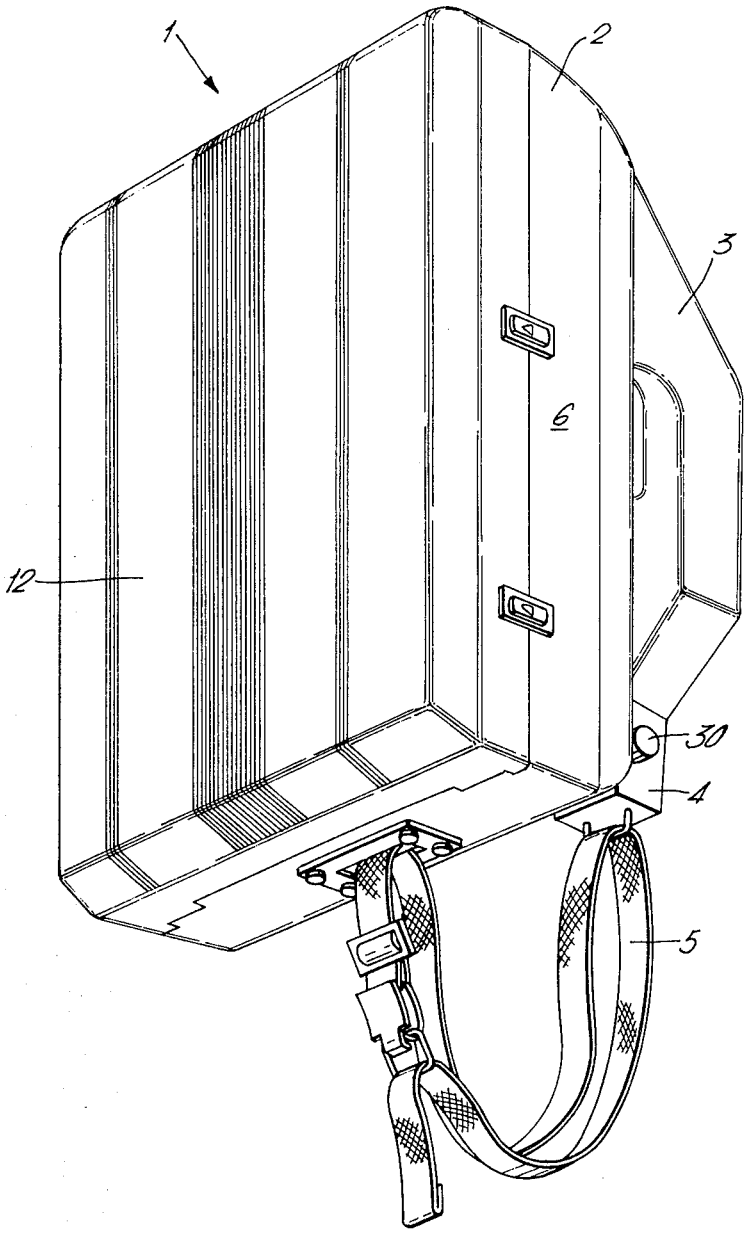
FIG. 2 is a perspective rear view of the buoyancy control apparatus of FIG. 1.
Figure 3:
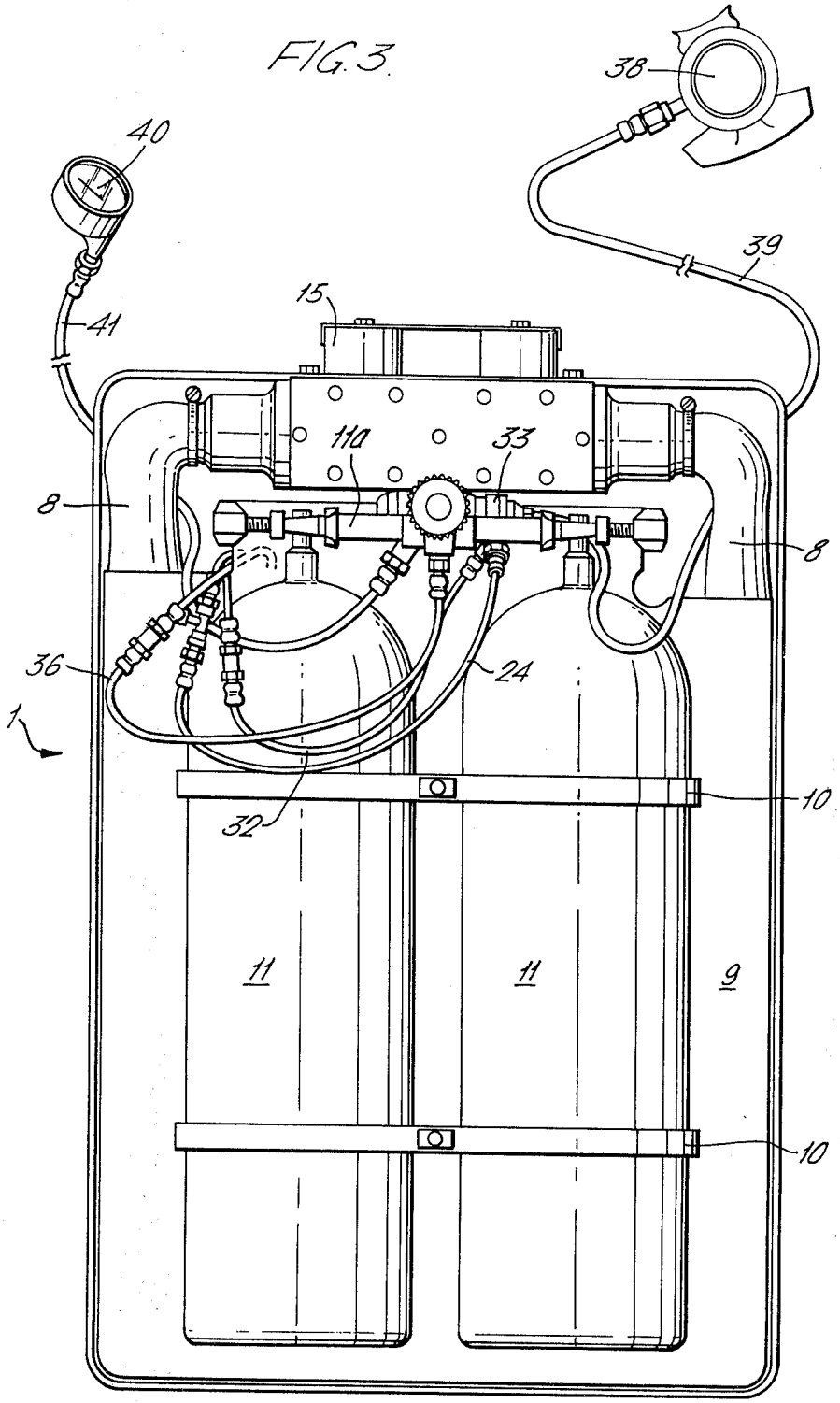
FIG. 3 is a rear view of the buoyancy control apparatus of FIG. 1 with the rear part of the housing removed.
Figure 4:
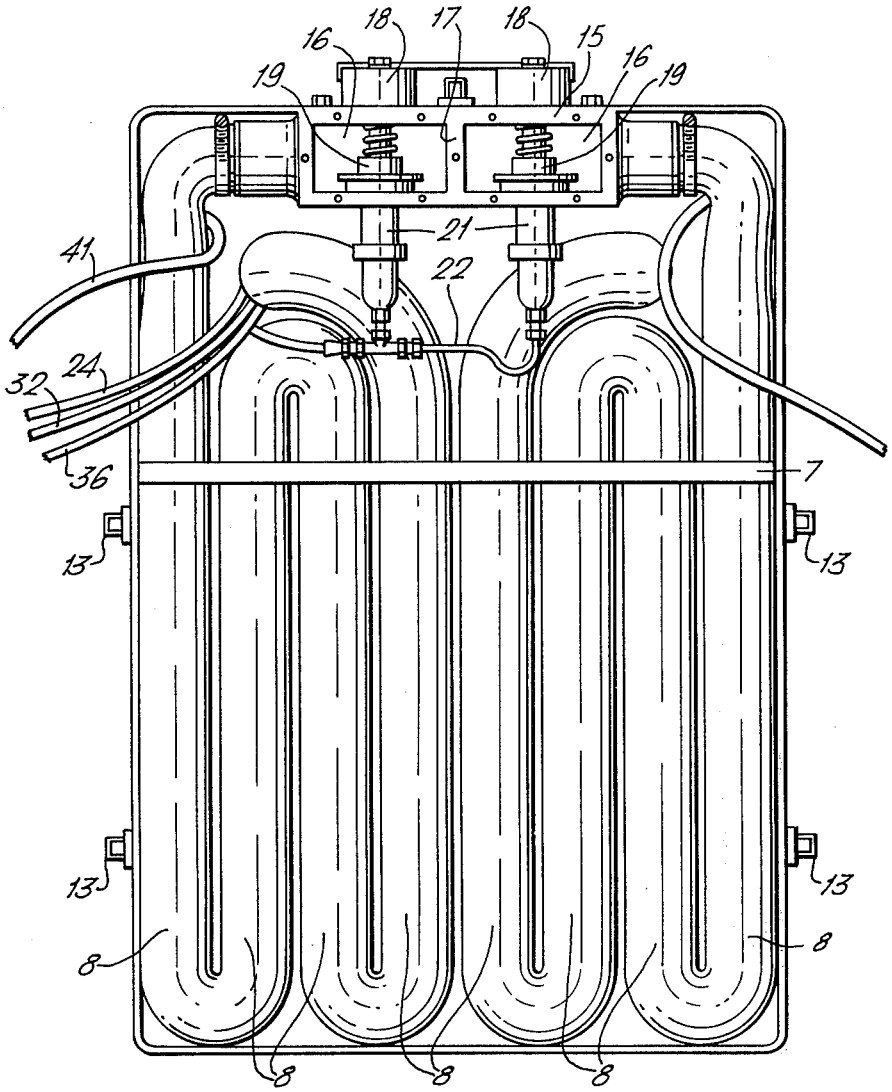
FIG. 4 is a rear view of the buoyancy control apparatus of FIG. 1 with the inner dividing wall removed.

A buoyancy control apparatus 1 in accordance with a preferred embodiment of the present invention comprises a back-pack housing 2 having a pair of supporting arms 3 adapted to extend over the shoulders of a diver. The arms 3 are joined at their lower ends in a central control unit 4 to the base of which is releasably attached a retaining strap 5. The strap 5 is attached to the base of the housing 2 and is adapted to extend under the crotch of the diver.

The housing 2 is formed of a front part 6 from which the arms 3 extend and which is open at its rear. A holder 7 having a plurality of spaced holes extends across part 6 to receive vertically extending portions of tubing 8. An inner dividing wall 9 substantially covers the tubing 8 and carries clamps 10 to receive a pair of conventional compressed air cylinders 11. The housing 2 is completed by a rear part 12 which is releasably attached to the front part 6 by clips 13.

The tubing 8 is looped within the housing 2, being supported therein by passage through the holes in the holder 7. The inlet ends of the tubing pass one through each of the arms 3 to the control unit 4 for a purpose hereinafter described. In the center of the tubing remote from the inlet, there is provided a fluid outlet assembly 15. This assembly 15 comprises a pair of exhaust chambers 16 separated by a central wall 17. Each chamber has at one side a spring-loaded pressure exhaust valve 18 set to open when the pressure in the chamber exceeds 38 psig. At the opposite side of each chamber is a gas outlet valve 19 spring-biased to a closed position. Each valve 19 is opened against the spring-bias by means of a piston 20 moving in response to air pressure in a cylinder 21. These cylinders 21 are connected by a high pressure feed-line 22 to a valve 23 situated in the control unit 4.

The valve 23 has an inlet port connected by a line 24 directly to the manifold 11*a* connected to the air cylinders 11. In addition to the outlet port connected to line 22, the valve 23 has a second outlet, or exhaust, port connected to line 25 which terminates in an exhaust orifice in the control unit 4. The valve 23 is operated by a stem 26 which extends forwardly through manifold 8*a* to terminate in a push-button 27. The stem 26 is biased to a forward position by a spring 28. In this forward position, the first and second outlet ports are connected by a passage within the body of valve 23 thereby permitting exhaust of gas from cylinders 21 under the pressure of the springs of valves 19. When the push-button 27 is depressed (i.e. pushed rearwardly), the stem 26 moves to close the passage connecting the outlet ports and to connect the inlet port with the first outlet port by a passage in the body of the valve 23 thereby admitting compressed gas from air cylinder 11 to the valve actuator cylinders 21.

Figure 5:
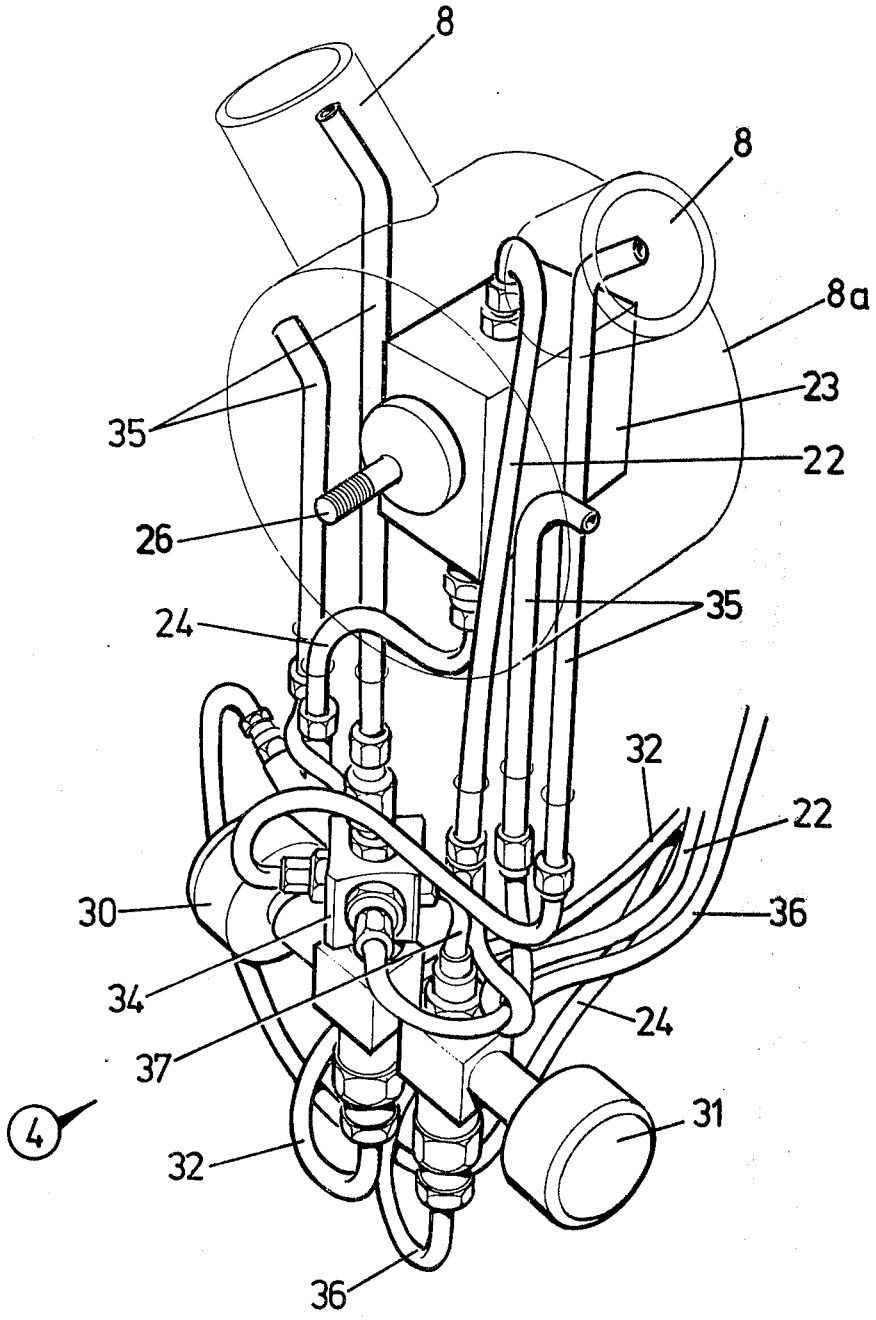
FIG. 5 is a detail of the compressed air control mechanism of the control unit of the buoyancy control apparatus of FIG. 1.
Figure 6:
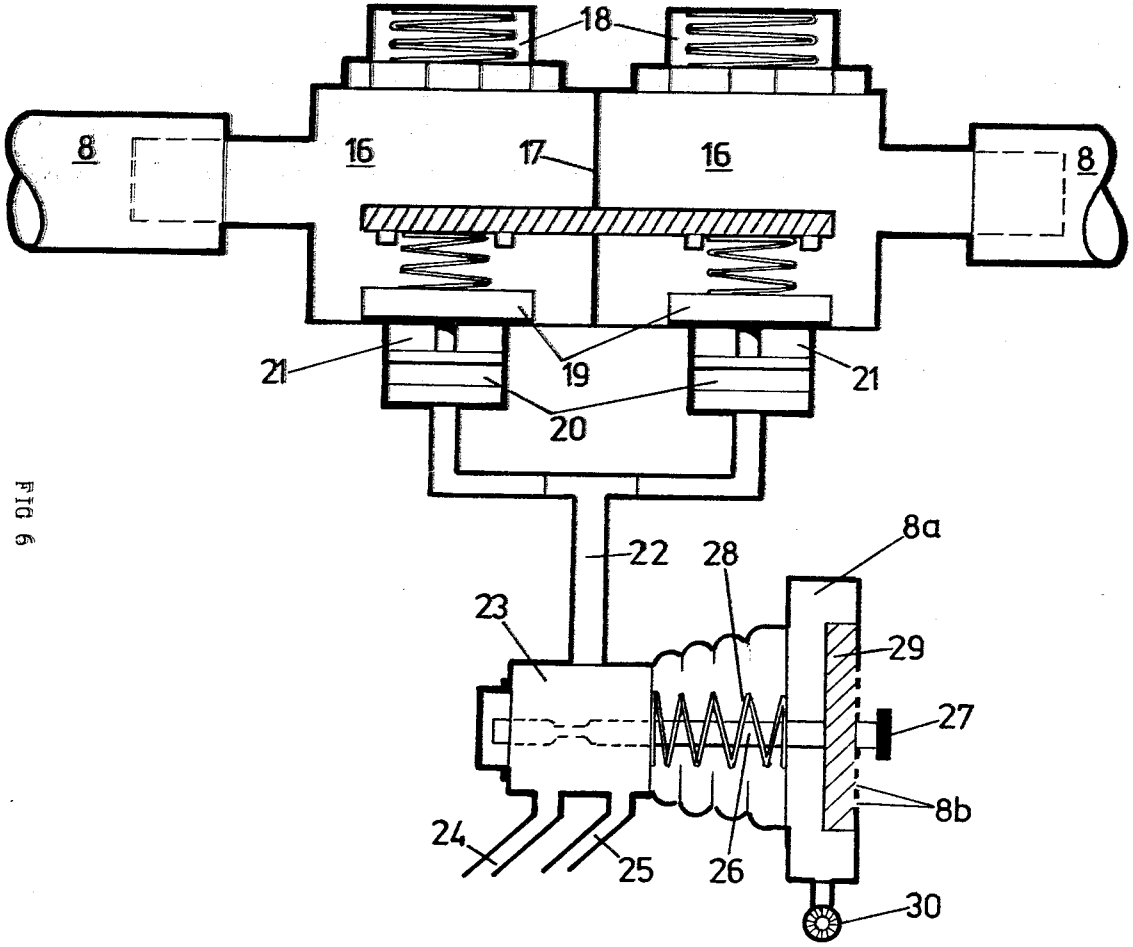
FIG. 6 is a diagrammatic representation of the inlet and outlet valving mechanisms to the reservoir tubing of the buoyancy control apparatus of FIG. 1.

The valve 23 is located in a cylindrical chamber 8*a* (shown in ghost lines in FIG. 5) to which the respective inlet ends of the tubing 8 are connected. The ends of chamber 8*a* are closed in respective walls but the front wall has a plurality of holes 8*b* spaced around its center to permit water to enter the chamber and thence the tubing 8. The holes 8*b* are normally closed by a disc-shaped closure member 29 carried by the stem 26. When the stem is in its forward position, the member 29 presses against the rear face of the front wall of chamber 8*a* to prevent entry of water through holes 8*b*. However, when stem 26 is moved rearwardly by depression of button 27, the member 29 is moved rearwardly from the wall allowing water to flow through the holes 8*b* into the chamber 8*a*.

The control unit 4 also carries a pair of screw-valves 30, 31 of the type conventionally used in compressed air systems. The valve 30 controls the flow of compressed air at a pressure of about 200 psig from a line 32 and from a pressure reducer 33 connected to the manifold 11*a* to reduce the pressure of the air from the 3,000 psig of the air cylinder 11 to the required 200 psig. The air passing through the valve 30 when open is directed to a manifold 34 from which four lines 35 extend.

Two of said lines 35 debouch into the respective ends of tubing 8 to deliver air directly into said tubing whilst the other two lines 35 are shorter in length and debouch air into the chamber 8*a* itself.

The valve 31 is connected by line 36 to the manifold 11*a*. The pressure in the line 36 is not reduced, i.e. it is at the full pressure of 3,000 psig. The outlet of valve 31 is also connected to the manifold 34 via line 37 to provide an emergency source of air pressure for rapidly expelling water from the tubing 8.

A face mask 38 is connected via line 39 to the pressure reducer 33 to provide a breathing supply for a diver using the apparatus 1. A pressure gauge 40 is also connected to the pressure reducer 33 via line 41.

Non-return valves are provided in lines 25 and 36 to prevent flow back of water into the pneumatic circuits.

In operation, water may be admitted to the unit to decrease its buoyancy by depressing the button 27 thereby simultaneously moving the closure member 29 to permit entry of water through holes 8*b* into the chamber 8*a* and thence into tubing 8. Said movement of button 27 also connects line 22 to line 24 thereby allowing air to pass into the cylinders 21 to open the valves 19 permitting exit of air from the tubing 8 via the outlet chambers 16. In this manner, the pressure of water in the vicinity of the diver causes water to enter the tubing 8 to displace air through the open valves 19. When the diver has reached the required operating depth, or has reduced the buoyancy to the desired amount, the button 27 is released and allowed to close under the action of spring 28. The closure member 29 returns to its closed position preventing additional water from passing through the holes 8*b* and the compressed gas in cylinders 21 and line 22 is allowed to exhaust through line 25, whence the valves 19 close under the action of their spring-bias. In the event that the apparatus 1 is used with the diver in an inverted attitude, depression of button 27 to decrease buoyancy will, of course, result in the admission of water through valves 19 and the expelling of air through holes 8*b*.

When it is desired to increase buoyancy, the screw-valve 30 is turned to permit controlled entry of compressed air (at 200 psi) through lines 35 into the chamber 8*a* and tubing 8. The entry of this air causes fluid pressure in the tubing 8 to exceed 38 psi, whence valves 18 open against their spring-bias permitting fluid to exhaust from the tubing 8 through those valves. Air is admitted through valve 30 until sufficient water has been exhausted through the valves 18 to increase the buoyancy to the desired level, whence the valve 30 is closed allowing valves 18 to close when the pressure in the tubing 8 has reduced to below 38 psi. The looped arrangement of tubing 8 ensures that water is effectively and progressively expelled from the tubing by the air pressure.

In an emergency situation where the diver wishes to rapidly increase buoyancy, the valve 31 is opened causing air at a pressure of 3,000 psi to enter the lines 35 via line 37 thereby rapidly exhausting all of the water in the tubing 8.

It will be appreciated that the invention is not restricted to the particular embodiment specifically described above and that many modifications and alterations may be made to the unit particularly described without departing from the scope of the invention as defined in the following claims. In particular, adjustable pressure-sensitive valves can be provided in the pneumatic circuits to permit automatic adjustment of the buoyancy to a desired value.

I claim:

1. A buoyancy control apparatus for carrying by a diver comprising:

frame means supporting coiled or looped tubular fluid-tight reservoir means;

carrying means for attachment of the frame means to a diver;

water inlet valve means for admitting water to said reservoir from externally of the apparatus to displace gas from the reservoir;

gas outlet valve means for releasing said displaced gas from the reservoir to externally of the apparatus;

gas inlet valve means for admitting compressed gas to the reservoir to displace water from the reservior; and water outlet valve means for releasing said displaced water from the reservoir, whereby water and gas can be selectively admitted to the reservoir to displace gas and water respectively already in the reservoir thereby to change to buoyancy of the apparatus.

2. The apparatus according to claim 1 wherein said water inlet and outlet valve means connect the reservoir means with the ambient environment of the apparatus.

3. The apparatus according to claim 1 wherein the apparatus includes a reservoir of compressed gas.

4. The apparatus according to claim 3 wherein the gas is air.

5. The apparatus according to claim 1 wherein the fluid-tight reservoir means comprises flexible tubing disposed within said frame means.

6. The apparatus according to claim 5 wherein the fluid reservoir means comprises two or more equal lengths of tubing connected at one end thereof to a common fluid inlet manifold and connected at the other end thereof to separate outlet chambers having commonly operated control means disposed therein.

7. The apparatus according to claim 1 comprising a common manually operable mechanism controlling the water inlet valve means and gas outlet valve means.

8. The apparatus according to claim 7 wherein the gas outlet valve means is a compressed gas pressure-controlled valve and the apparatus includes a compressed gas pressure line having control valve means operated by said common mechanism to control the gas outlet valve.

9. The apparatus according to claim 8 including spring means biased the said common mechanism to a closed position where the water inlet and gas outlet valve means are closed, and handle means depressable to move said control mechanism to an open position where the water inlet and gas outlet valve means are open.

10. The apparatus according to claim 1 wherein the water outlet valve means is a pressure-responsive valve actuated by fluid pressure in the reservoir exceeding a predetermined threshold level.

11. The apparatus according to claim 1 comprising a second gas inlet valve means for admitting compressed gas at a higher pressure than that admitted by the first-mentioned gas inlet valve means.

* * * * *